US008655262B2

(12) United States Patent
White

(10) Patent No.: US 8,655,262 B2
(45) Date of Patent: Feb. 18, 2014

(54) METHOD AND APPARATUS FOR PROVIDING AN AUDIO SIGNAL FOR AN EVENT

(75) Inventor: Scott White, Austin, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 793 days.

(21) Appl. No.: 12/207,357

(22) Filed: Sep. 9, 2008

(65) Prior Publication Data

US 2010/0061567 A1 Mar. 11, 2010

(51) Int. Cl.
*H04H 40/90* (2008.01)

(52) U.S. Cl.
USPC ..... 455/3.01; 455/3.04

(58) Field of Classification Search
USPC ..... 455/3.02, 3.2, 3.06, 3.01, 3.03, 3.04, 455/411, 522; 381/66, 40, 77, 2–4, 10, 381/14–16, 78, 79, 80–82; 348/729, 6; 379/93.23
See application file for complete search history.

(56) References Cited

U.S. PATENT DOCUMENTS

| | | | | |
|---|---|---|---|---|
| 7,995,770 | B1 * | 8/2011 | Simon | 381/82 |
| 2001/0053999 | A1 * | 12/2001 | Feinberg | 705/14 |
| 2003/0092376 | A1 * | 5/2003 | Syed | 455/3.06 |
| 2005/0229212 | A1 * | 10/2005 | Kuether et al. | 725/58 |
| 2005/0234875 | A1 * | 10/2005 | Auerbach et al. | 707/3 |
| 2007/0021056 | A1 * | 1/2007 | Arseneau et al. | 455/3.06 |
| 2009/0220104 | A1 * | 9/2009 | Allison | 381/77 |

* cited by examiner

*Primary Examiner* — Vivian Chin
*Assistant Examiner* — Friedrich W Fahnert

(57) ABSTRACT

A method and apparatus for providing an audio signal for an event at a venue are disclosed. For example, the method authorizes a customer endpoint device, wherein the authorizing enables the customer endpoint device to decode the audio signal for the event. The method transmits the audio signal for the event at the venue.

15 Claims, 3 Drawing Sheets

METHOD AND APPARATUS FOR PROVIDING AN AUDIO SIGNAL FOR AN EVENT

The present invention relates generally to communication networks and, more particularly, to a method and apparatus for providing an audio for an event in a network, e.g., a broadcast network and the like.

BACKGROUND OF THE INVENTION

Customers attending live events may have difficulties hearing and enjoying the audio supplied by the event venue. For example, a customer attending events such as live concerts, sports games, and the like, may have difficulty enjoying the audio broadcast due to various audio degrading factors.

In one example, the audio may be degraded because of the acoustics of the venue. In another example, the listener may be located too close to an amplifier. In another example, crowd noise may be a factor. In one example, the listener may be hearing impaired and may need a personal amplifier, e.g., a hearing aid. Unfortunately, the hearing aid will amplify the audio broadcast and the crowd noise simultaneously, thereby making enjoyment difficult if not impossible.

SUMMARY OF THE INVENTION

In one embodiment, the present invention discloses a method and apparatus for providing an audio signal for an event at a venue. For example, the method authorizes a customer endpoint device, wherein the authorizing enables the customer endpoint device to decode the audio signal for the event. The method transmits the audio signal for the event at the venue.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
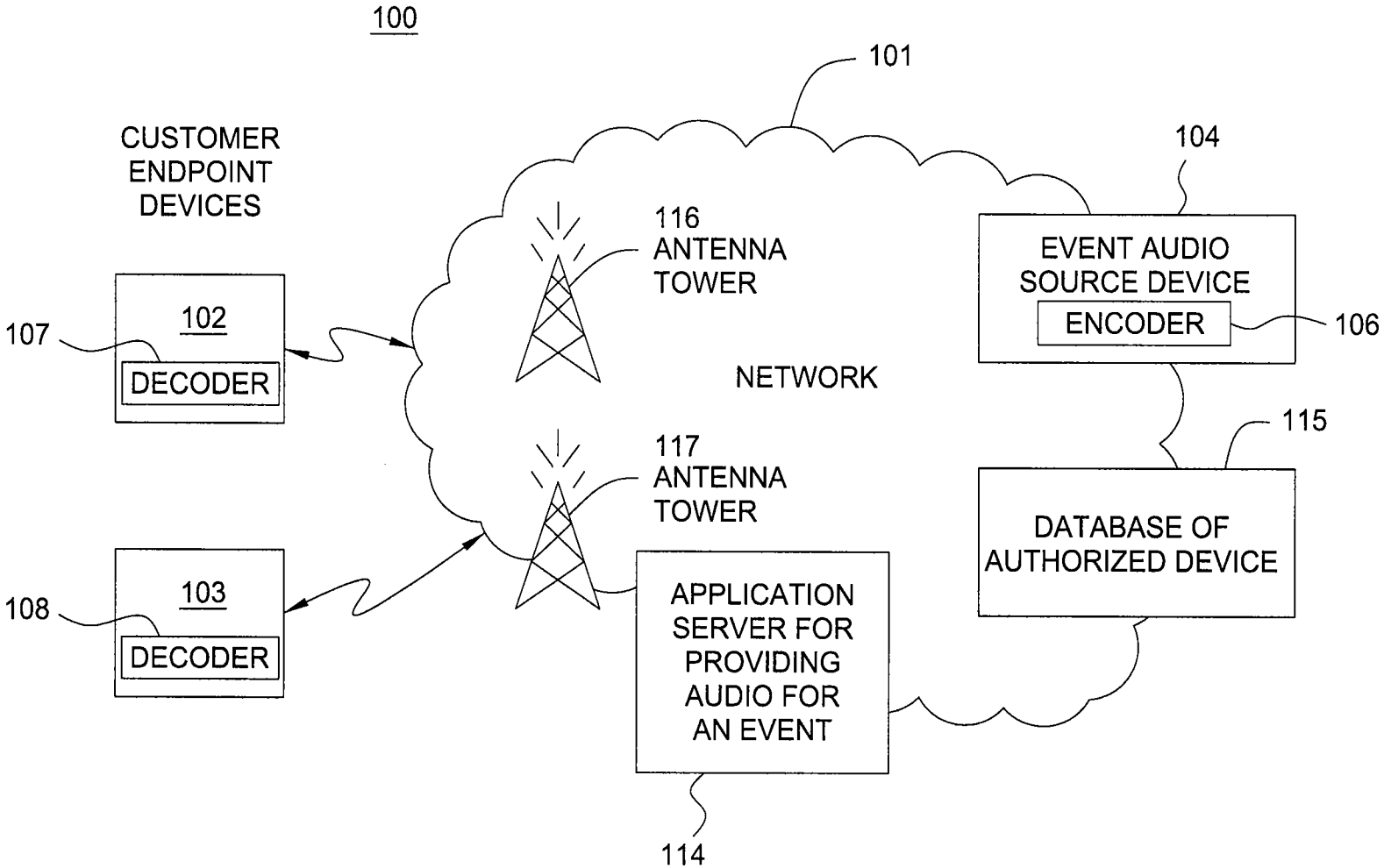
FIG. 1 illustrates an exemplary network with the current invention for providing an audio for an event.

The present invention broadly discloses a method and apparatus for providing an audio broadcast (or broadly an audio signal) for an event in a network, e.g., a broadcast network, and the like. FIG. 1 illustrates an exemplary network 100 with the current invention for providing an audio broadcast for an event. In one embodiment, the network 100 may comprise a plurality of endpoint devices 102-103 configured for communication with the network 101 (e.g., a wireless network, a Local Access Network (LAN), etc). In one embodiment, the network 101 comprises an application server 114, a database 115, an event audio source device 104, and one or more antenna towers 116 and 117.

In one embodiment, the endpoint devices 102-103 may comprise customer endpoint devices capable of receiving an audio signal from a broadcast network 101. For example, the endpoint devices may comprise wireless headphones (e.g., capable of receiving audio signals only without the capability to transmit audio signals), cellular phones, and the like.

The antenna towers 116 and 117 (or broadly transmitters) may be used for transmitting and receiving radio waves carrying communication signals to and from a plurality of users, e.g., users communicating via endpoint devices 102 and 103. The application server 114 may comprise any server or computer that is well known in the art. The database 115 may be any type of electronic collection of data that is also well known in the art.

Those skilled in the art will realize that although FIG. 1 depicts only two endpoint devices, an application server, a database, an audio source device, two antenna towers, and so on, the communication network 100 may be expanded by including additional endpoint devices, access networks, application servers, transmission devices, audio source devices without altering the present invention.

As discussed above, customers attending live events may have difficulties hearing and enjoying the audio signals supplied by the event venue. For example, customers attending live concerts and sports events may have difficulty enjoying the audio broadcast due to the crowd noise. In one example, the customer may wish to be able to move around the venue (e.g., a stadium, a concert hall, an arena, a theater, and the like) without losing the ability to enjoy the event. For example, a customer may wish to continue listening to the audio signal while purchasing meals, drinks, etc.

In one embodiment, the service provider implements the current method for providing an audio signal for an event via an application server 114. The application server 114 communicates with the database 115 for storing pertinent customer information for providing audio signal to customers.

In one embodiment, the application server 114 may interact with the customer endpoint devices 102 and 103 and receive requests for the audio signal to be transmitted to the customer endpoint devices 102 and 103. For example, the customer endpoint device may be brought to the event venue by an individual planning to use the device to receive the audio broadcast. For example, a customer may provide the endpoint device 102 or 103 to an event venue personnel and request for authorization to receive an audio broadcast during a live event.

The venue personnel may then facilitate adding the customer endpoint device to a list of authorized devices to receive the audio signal. For example, venue personnel may send an authorization request to the application server 114 on behalf of the customer.

The application server 114 may perform authorizations, authentications, etc. and update the database 115. The authorization enables the customer endpoint device to receive the audio signal. In one embodiment, the authorization of a customer endpoint device to receive an audio signal may comprise providing the customer endpoint device with a code or key such that the device is able to decode the audio signal.

For example, the customer endpoint device may be rented by a customer from the venue service provider upon entering the venue. In this scenario, the customer endpoint device has been previously loaded with a proper decoding key for receiving the encoded audio broadcast for a specific event. In other words, the customers may be provided with endpoint devices that are pre-authorized to receive the audio signal for an event upon entering a venue for the event. For example, each customer who wishes to receive broadcast audio via an endpoint device during a live broadcast may be issued a pre-authorized headphone by venue personnel when entering the venue for the event in exchange for a rental fee. The headphone may then be returned when exiting the venue after the event is over.

In another example, the customer endpoint device may have the ability to receive a decoding key from the venue service provider. For example, a customer may prefer to bring along his or her own endpoint device. In this example, such device may be a customer's smart endpoint device with a speaker such as a cell phone, a personal digital assistant (PDA), and the like. Upon entering the event venue, the customer's endpoint device may then be provided with the appropriate decoding key by designated service provider personnel, e.g., personnel staffing a kiosk for providing the decoding key for the audio broadcast, ticket agents, etc. The customer endpoint device is then able to decode the locally provided audio signal. That is, the application server 114 may control the encoding and decoding of the broadcast audio signal and provide a decoding key to customers who request to receive the audio signal.

When the event audio source 104 begins transmitting the audio signal for the event (e.g., a singer singing a song into a microphone, an announcer providing a play by play announcement for a sports event, a microphone capturing sound on the field of a sports event, a microphone capturing sound on a stage, and the like), customer endpoint device 102 or 103 may then decode the encoded audio signal. For example, the customer endpoint device uses the decoding key (e.g., via decoders 107 and 108) to enable the customer to listen to the encoded audio signal.

In one embodiment, the event audio source 104 employs an encoder 106 that is capable of encoding the audio signal before it is forwarded to the antenna towers 116 and 117 for transmission. The code or key used by the encoder 106 to encode the audio signal can be selected by the application server 114 for each live event. The code or key can be selectively changed for different live events.

In one embodiment, the power of the audio broadcast is selected at a level that is sufficient to only cover the immediate local area of the venue, e.g., the interior of a stadium or the interior of a stadium plus a small area outside of the stadium and the like. Furthermore, to achieve this localized broadcast, the number and/or positioning of the antennas can be tailored or adjusted accordingly for a particular venue.

In one embodiment, the authorization to receive an audio signal is issued on a short-term basis, e.g., only for a specific event. For example, the service provider may broadcast audio for a specific event from a sound mixing device for reception by authorized devices, e.g., headphones, during the specific event.

In another embodiment, the authorization may be valid for multiple events at a venue. For example, a customer may subscribe for a service that enables his/her customer endpoint device to receive an audio signal for all events at a venue per season. For example, a season ticket holder for a game may wish to subscribe to receive the audio signal for all events in which the customer's season ticket is valid.

In one embodiment, the application server 114 may provide the authorization to receive the encoded audio signal to a list of customer endpoint devices via another network, e.g., the Internet, cellular network, etc. For example, a customer may subscribe for receiving audio broadcast at an event venue while subscribing to attend the event (e.g., while purchasing a ticket online). The application server may then perform the authorization. i.e., providing the pertinent code for a particular event, in advance such that the customer is able to receive the audio broadcast at the venue without having to spend time to interact with service personnel at the venue. The customers may then immediately listen to the audio broadcast upon arriving at the venue.

In one embodiment, the customer is able to control the volume of the audio signal being received. This enables the customer to increase the volume free of crowd noise, acoustics troubles, etc. For example, the audio signal may be received directly from the sound mixing device (e.g., a mixing board). This embodiment may be used to amplify the audio signal without the crowd noise. For example, the customer may be hearing impaired and uses a hearing aid that unfortunately amplifies both the sound of the live event and the surrounding crowd noise simultaneously. To address this criticality, the current method enables the listener to amplify only the audio signal received directly from the sound mixing board (i.e. without amplifying the surrounding noise signal).

In one embodiment, the service provider may also provide other media content, e.g., advertisements, schedules for upcoming events, sales of items at the stores located within the venue, traffic reports to assist customers leaving a large live event, etc., to the list of authorized endpoint devices to receive the audio signal. In one embodiment, the other media content may be provided before or after a live event.

In one embodiment, the venue service provider may also provide audio signal for a live event to listeners outside of the venue for the event. For example, a popular event may have an overflow crowd outside of the venue. The overflow crowd may include individuals who may wish to get an audio broadcast of the event even though they are able to view the live event. In one example, the service provider may add the listener's endpoint device (e.g. headphone) to a list of authorized receiving devices. In another example, the service provider may provide a pre-authorized receiving device (e.g. headphone) to each individual in an overflow crowd who wishes to listen to the audio broadcast.

In one embodiment, the receiving endpoint devices may have controlled access to the audio signal. For example, the venue service provider may embed access control technology to prevent the audio from being outputted to an audio recording device. For example, the service provider may embed a Digital Rights Management (DRM) technology in the customer endpoint devices to prevent recording of the live event.

Those skilled in the art would realize that the application server 114 and/or the event audio source device 104 may be located in an access network, an enterprise customer's network, etc. In one example, the event audio source device may be located in the same network as the application server 114. In another example, the application server 114 may be located in a wire based network while the event audio source device, antenna, etc. are located in a wireless network. As such, the exemplary network 100 is not intended to limit the present invention to a particular implementation or deployment.

Figure 2:
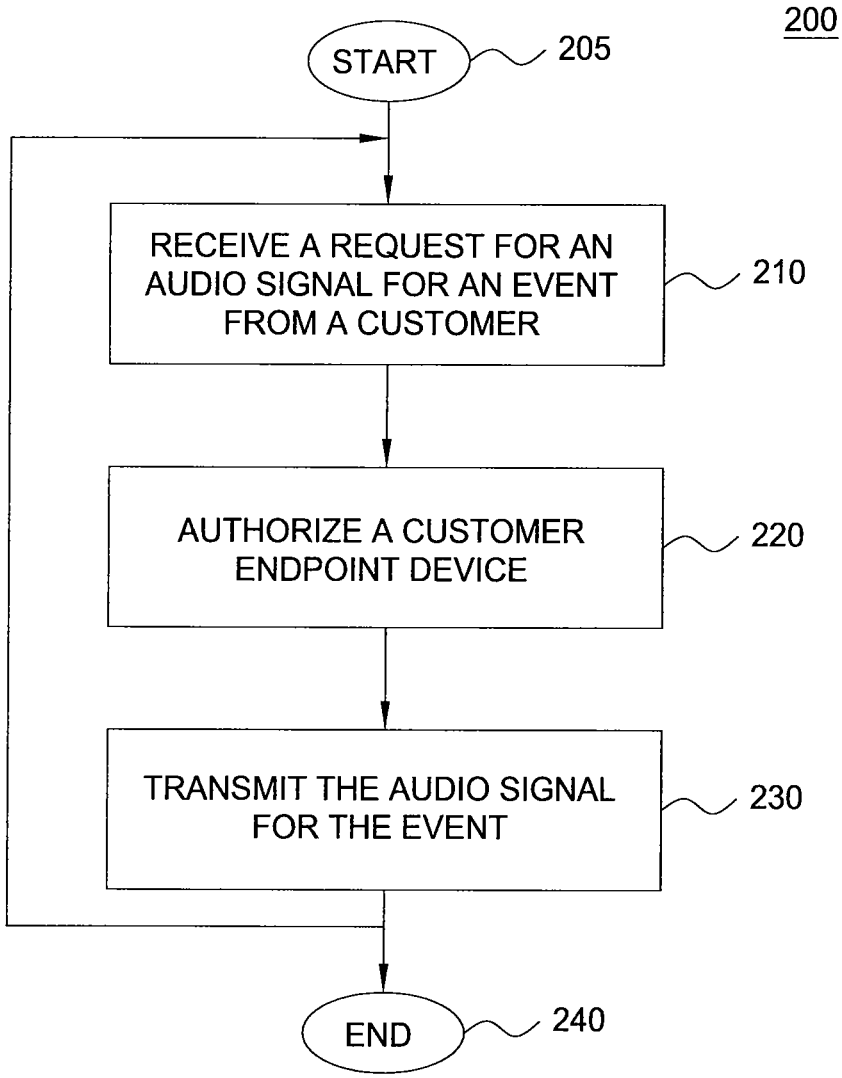
FIG. 2 illustrates a flowchart of a method for providing an audio for an event.

FIG. 2 illustrates a flowchart of a method 200 for providing an audio broadcast for a live event in a network. For example, one or more steps of method 200 can be implemented by the application server 114. Method 200 starts in step 205 and proceeds to step 210.

In step 210, method 200 receives a request for an audio signal for an event from a customer. For example, a customer attends a game, concert, etc. and requests to receive an audio signal directly from the sound mixing board via a customer endpoint device. It should be noted that step 210 can be an optional step. For example, if the endpoint devices are provided by the service provider of the venue, then there is no need to receive a request for an audio signal by a customer endpoint device.

In step 220, method 200 authorizes a customer endpoint device, wherein the authorizing enables the customer endpoint device to receive the audio signal for the event. For example, the authorization may enable the customer endpoint device to receive a decoding key such that the device is able to decode an audio signal transmitted after undergoing an encoding process.

In step 230, method 200 transmits the encoded audio signal for the event. For example, the method transmits the audio signal to customers via one or more radio antennas distributed throughout a venue. The method then proceeds to step 240 to end processing the current request, or returns to step 210 to continue receiving other requests.

Figure 3:
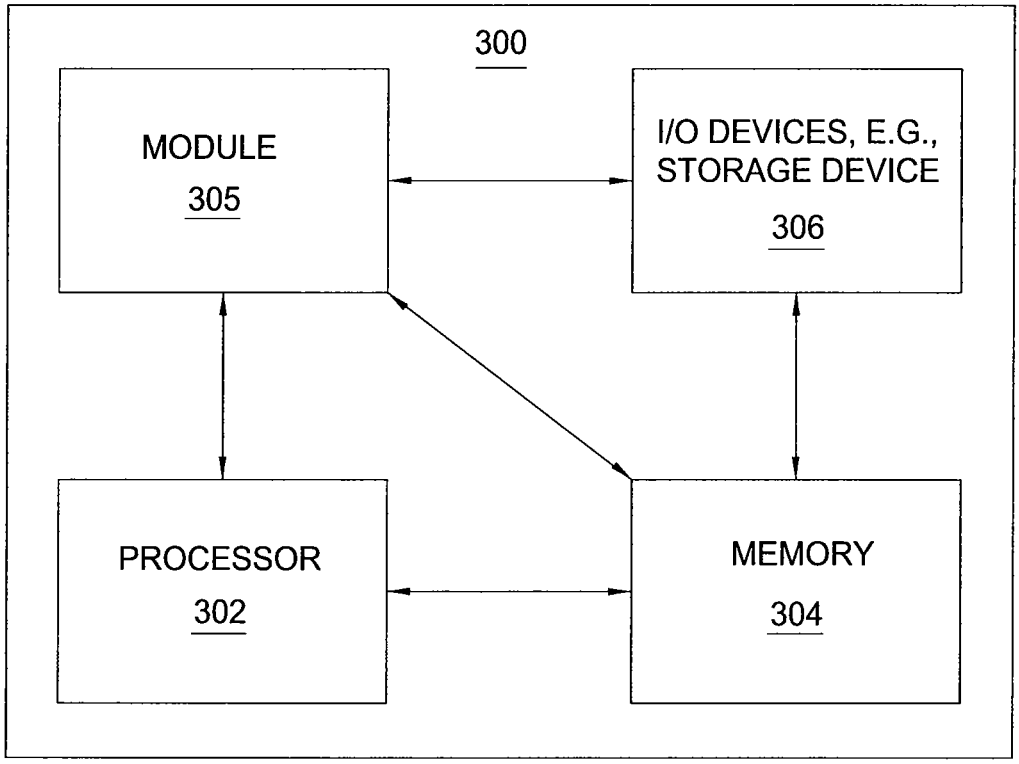
FIG. 3 illustrates a high-level block diagram of a general-purpose computer suitable for use in performing the functions described herein.

It should be noted that although not specifically specified, one or more steps of method 200 may include a storing, displaying and/or outputting step as required for a particular application. In other words, any data, records, fields, and/or intermediate results discussed in the method 200 can be stored, displayed and/or outputted to another device as required for a particular application. Furthermore, steps or blocks in FIG. 2 that recite a determining operation, or involve a decision, do not necessarily require that both branches of the determining operation be practiced. In other words, one of the branches of the determining operation can be deemed as an optional step FIG. 3 depicts a high-level block diagram of a general-purpose computer suitable for use in performing the functions described herein. As depicted in FIG. 3, the system 300 comprises a processor element 302 (e.g., a CPU), a memory 304, e.g., random access memory (RAM) and/or read only memory (ROM), a module 305 for providing an audio broadcast for an event in a network, and various input/output devices 306 (e.g., storage devices, including but not limited to, a tape drive, a floppy drive, a hard disk drive or a compact disk drive, a receiver, a transmitter, a speaker, a display, a speech synthesizer, an output port, and a user input device (such as a keyboard, a keypad, a mouse, and the like)).

It should be noted that the present invention can be implemented in software and/or in a combination of software and hardware, e.g., using application specific integrated circuits (ASIC), a general purpose computer or any other hardware equivalents. In one embodiment, the present module for providing an audio broadcast for an event in a network or process 305 can be loaded into memory 304 and executed by processor 302 to implement the functions as discussed above. As such, the present method 305 for providing an audio broadcast for an event in a network (including associated data structures) of the present invention can be stored on a computer readable medium, e.g., RAM memory, magnetic or optical drive or diskette and the like.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for providing a radio signal carrying an audio signal for a live event at a venue, comprising:

receiving, by a processor of an application server of a service provider, a request for the radio signal for the live event from a customer endpoint device, wherein the customer endpoint device is located at the venue;

authorizing, by the processor, the customer endpoint device, wherein the authorizing enables the customer endpoint device to decode the radio signal for the live event that is occurring at the venue, wherein the authorizing the customer endpoint device comprises providing the customer endpoint device with a decoding key at the venue to decode the radio signal; and transmitting, by the processor, the radio signal carrying the audio signal for the live event at the venue, wherein a power level of the radio signal is selected to only cover the venue in which the live event is occurring.

2. The method of claim 1, wherein the authorizing enables the customer endpoint device to decode the radio signal for the live event only.

3. The method of claim 1, wherein a customer is provided with the customer endpoint device from a service provider of the venue.

4. The method of claim 1, wherein the authorizing is performed via a network.

5. The method of claim 1, wherein a customer is able to control a volume of the audio signal received via the customer endpoint device.

6. The method of claim 1, wherein the radio signal for the live event is capable of being received only locally relative to the venue.

7. The method of claim 1, wherein the request for the radio signal is received from a venue personnel sending the request on behalf of the customer.

8. A system for providing a radio signal carrying an audio signal for a live event at a venue, comprising:

a hardware processor of an application server of a service provider; and a computer-readable medium storing a plurality of instructions which, when executed by the processor, cause the processor to perform operations, the operations comprising:

receiving a request for the radio signal for the live event from a customer endpoint device, wherein the customer endpoint device is located at the venue;

authorizing the customer endpoint device, wherein the authorizing enables the customer endpoint device to decode the radio signal for the live event that is occurring at the venue, wherein the authorizing the customer endpoint device comprises providing the customer endpoint device with a decoding key at the venue to decode the radio signal; and transmitting the radio signal carrying the audio signal for the live event at the venue, wherein a power level of the radio signal is selected to only cover the venue in which the live event is occurring.

9. The system of claim 8, wherein the authorizing enables the customer endpoint device to decode the radio signal for the live event only.

10. The system of claim 8, wherein a customer is provided with the customer endpoint device from a service provider of the venue.

11. The system of claim 8, wherein the authorizing is performed via a network.

12. The system of claim 8, wherein a customer is able to control a volume of the audio signal received via the customer endpoint device.

13. The system of claim 8, wherein the radio signal for the live event is capable of being received only locally relative to the venue.

14. The system of claim 8, wherein the request for the radio signal is received from a venue personnel sending the request on behalf of the customer.

15. A non-transitory computer-readable medium storing a plurality of instructions which, when executed by a processor of an application server of a service provider, cause the processor to perform operations for providing a radio signal carrying an audio signal for a live event at a venue, the operations comprising:

receiving a request for the radio signal for the live event from a customer endpoint device, wherein the customer endpoint device is located at the venue;

authorizing the customer endpoint device, wherein the authorizing enables the customer endpoint device to decode the radio signal for the live event that is occurring at the venue, wherein the authorizing the customer endpoint device comprises providing the customer endpoint device with a decoding key at the venue to decode the radio signal; and transmitting the radio signal carrying the audio signal for the live event at the venue, wherein a power level of the radio signal is selected to only cover the venue in which the live event is occurring.

* * * * *